US010753048B2

(12) United States Patent
Brunninger

(10) Patent No.: US 10,753,048 B2
(45) Date of Patent: Aug. 25, 2020

(54) MACHINE WITH BALLAST RECEIVING DEVICE

(71) Applicant: Plasser & Theurer Export von Bahnbaumaschinen Gesellschaft m.b.H., Vienna (AT)

(72) Inventor: Manfred Brunninger, Altenberg (AT)

(73) Assignee: PLASSER & THEURER EXPORT VON BAHNBAUMASCHINEN GESELLSCHAFT M.B.H., Vienna (AT)

( * ) Notice: Subject to any disclaimer, the term of this patent is extended or adjusted under 35 U.S.C. 154(b) by 154 days.

(21) Appl. No.: 16/067,656

(22) PCT Filed: Jan. 2, 2017

(86) PCT No.: PCT/EP2017/000001
§ 371 (c)(1),
(2) Date: Jul. 2, 2018

(87) PCT Pub. No.: WO2017/129345
PCT Pub. Date: Aug. 3, 2017

(65) Prior Publication Data

US 2019/0003130 A1 Jan. 3, 2019

(30) Foreign Application Priority Data

Jan. 29, 2016 (AT) ..... A 44/2016

(51) Int. Cl.
*E01B 27/06* (2006.01)
*E01B 27/04* (2006.01)
*E01B 27/08* (2006.01)

(52) U.S. Cl.
CPC ..... *E01B 27/04* (2013.01); *E01B 27/08* (2013.01)

(58) Field of Classification Search
CPC ..... E01B 27/10; E01B 27/04; E01B 27/08; E01B 27/023; E02F 3/961; E02F 3/205; E02F 3/246; E02F 9/022
(Continued)

(56) References Cited

U.S. PATENT DOCUMENTS 2,899,759 A * 8/1959 Campbell ..... E01B 27/10 37/104
3,877,160 A * 4/1975 Plasser ..... E01B 27/023 37/104
(Continued)

FOREIGN PATENT DOCUMENTS

AT 352 168 B 9/1979
CH 550 282 A 6/1974
(Continued)

OTHER PUBLICATIONS

International Search Report of PCT/EP2017/000001, dated Apr. 4, 2017.

*Primary Examiner* — Robert E Pezzuto
(74) *Attorney, Agent, or Firm* — Collard & Roe, P.C.

(57) ABSTRACT

A machine having a ballast take-up device for taking up ballast located underneath a track. The take up device has an endless clearing chain guided in a chain channel. In a connecting joint from a transverse channel to a transport channel. There is also a ballast deflector blade pivotable about a pivot axis. Arranged on the ballast deflector blade is a ballast conveyor, designed for ballast transport in the direction towards a pivot axis by means of a conveyor drive. With this, it is possible to expand the operating range of the ballast take-up device, as needed.

8 Claims, 2 Drawing Sheets

Figure 1:
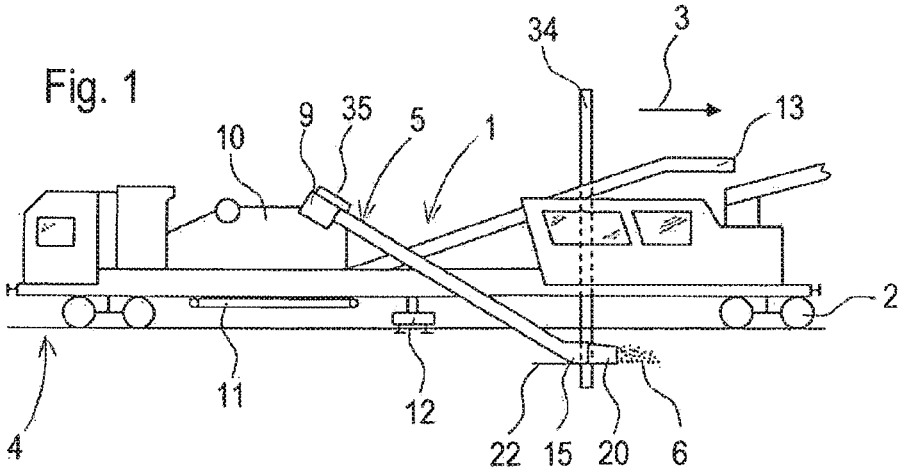

(58) Field of Classification Search
USPC ..... 37/104–107, 208, 217, 232, 782; 171/16
See application file for complete search history.

(56) References Cited

U.S. PATENT DOCUMENTS

| | | | | |
|---|---|---|---|---|
| 5,271,166 | A | 12/1993 | Theurer | |
| 6,598,325 | B2 * | 7/2003 | Theurer | E01B 27/04 104/7.3 |
| 7,845,098 | B1 * | 12/2010 | Huebner | E01B 27/04 37/104 |
| 9,206,557 | B2 * | 12/2015 | Theurer | E01B 27/04 |

FOREIGN PATENT DOCUMENTS

| | | | |
|---|---|---|---|
| CN | 101910518 | A | 12/2010 |
| EP | 0 152 643 | A1 | 8/1985 |
| EP | 0 538 760 | A1 | 4/1993 |
| EP | 2 238 296 | A1 | 10/2010 |
| GB | 2 134 574 | A | 8/1984 |

* cited by examiner

MACHINE WITH BALLAST RECEIVING DEVICE

CROSS REFERENCE TO RELATED APPLICATIONS

This application is the National Stage of PCT/EP2017/000001 filed on Jan. 2, 2017, which claims priority under 35 U.S.C. § 119 of Austrian Application No. A 44/2016 filed on Jan. 29, 2016, the disclosures of which are incorporated by reference. The international application under PCT article 21(2) was not published in English.

The invention relates to a machine having a ballast take-up device for taking up ballast located underneath a track by means of an endless clearing chain guided in a chain channel, wherein the chain channel is composed of a transverse channel located underneath the track, an empty channel and a transport channel provided for ballast transport, and a ballast deflector blade pivotable about a pivot axis is fastened in a connecting joint from the transverse channel to the transport channel.

A ballast take-up device of this type is known, for example, from EP 2 238 296 and is used for transport of the ballast located underneath the track to a cleaning screen. As soon as catenary masts are present alongside the track, the operative width of the clearing chain, predefined by the length of the transverse channel, is restricted. Ballast situated between the adjacent catenary masts remains in place uncleaned or must be shifted in the direction towards the track prior to the operation of the cleaning machine.

From EP 0 152 643, a ballast take-up device is known the operative range of which can be changed with the aid of pivotable auxiliary excavating chains or backhoes for treating a switch or crossing. A design of this type, matched to switch sections, requires a very large additional structural expense.

It is the object of the present invention to provide a machine of the type mentioned at the beginning with which it is possible by simplified structural measures to quickly expand the operative range of the ballast take-up device.

According to the invention, this object is achieved with a machine of the specified kind in that a ballast conveyor, designed for ballast transport in the direction towards the pivot axis by means of a conveyor drive, is arranged on the ballast deflector blade.

In addition to being a structurally very simple embodiment, a solution of this kind has the advantage that the ballast conveyor can be adjusted very quickly into the working position, if needed, or just as quickly into an inoperative position. In this last-mentioned position, the ballast take-up device can continue to be used for taking up ballast entirely unhindered and uninfluenced. By way of the rapid change between working- and inoperative positions by pivoting of the ballast deflector blade, a permanent operation of the ballast take-up device with continuous machine advance is possible without any limitation. The ballast conveyor can be positioned at the ballast deflector blade in such a manner that the latter can fulfil its hitherto known function entirely unobstructed. Every machine already in operation can be retrofitted very easily.

Additional advantages of the invention become apparent from the dependent claims and the drawing description.

The invention will be described in more detail below with reference to an embodiment represented in the drawing.

Figure 2:
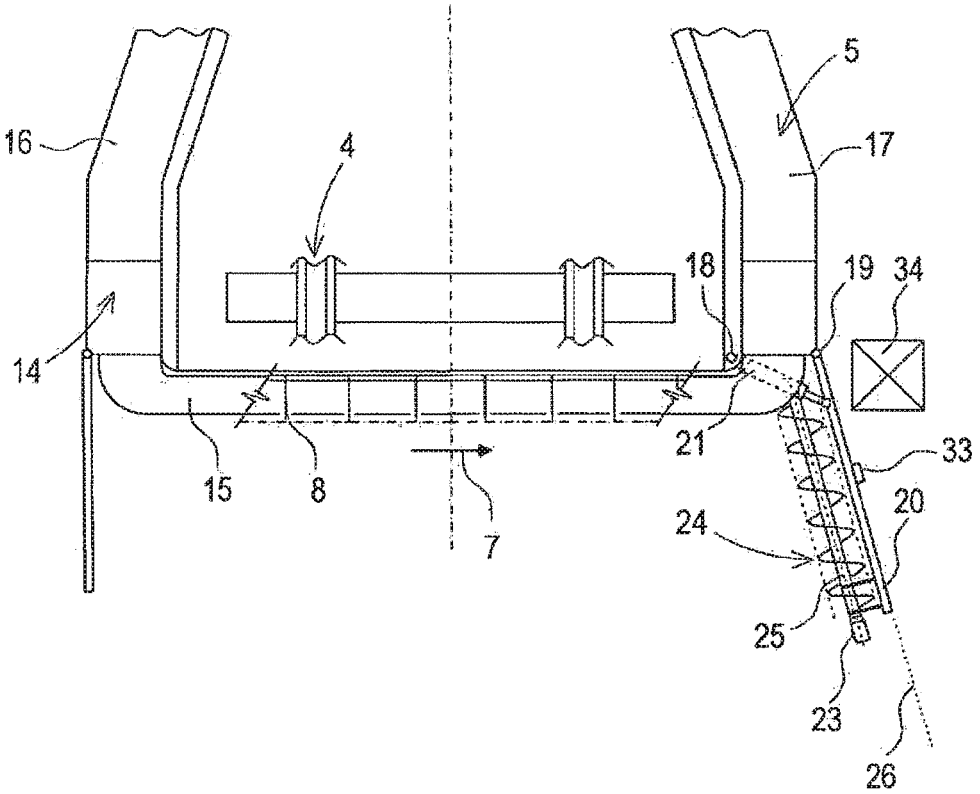
Figure 3:
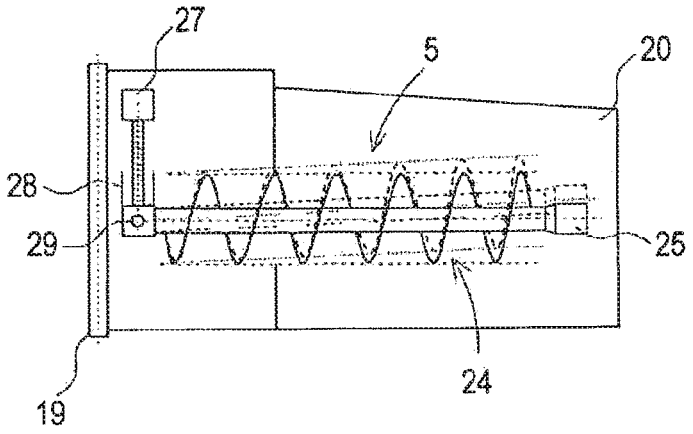
Figure 4:
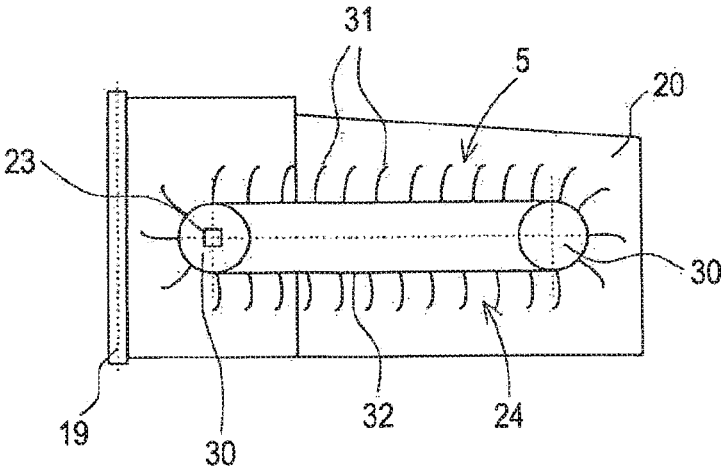

FIG. 1 shows a side view of a machine with a ballast take-up device for cleaning ballast, FIG. 2 shows an enlarged partial top view of the ballast take-up device, and FIGS. 3 and 4 each show a further variant.

A machine 1 shown in FIG. 1 is mobile on a track 4 by means of on-track undercarriages 2 in a working direction 3 and has a ballast take-up device 5, shown here in working operation, for taking up ballast 6. The vertically adjustable ballast take-up device 5 comprises an endless clearing chain 8, visible in FIG. 2, which is rotatable in a rotation direction 7 by means of a drive 35. The ballast 6 taken up by the clearing chain 8 underneath the track 4 is discharged via a discharge end 9 into a screening installation 10 for cleaning. A conveyor belt 11 is provided for discharging the cleaned ballast 6 immediately behind a track lifting device 12. Spoil accruing as a result of the cleaning is transported away by a conveyor belt 13.

The endless clearing chain 8 is guided in a chain channel 14 having an approximately U-shaped cross-section (see FIG. 2). Said chain channel 14 is composed of a transverse channel 15, situated underneath the track 4 during working operations, an empty channel 16 and a transport channel 17 provided for ballast transport. Fastened in a connecting joint 18 of the transverse channel 15 to the transport channel 17 is a ballast deflector blade 20. The latter is pivotable by means of a hydraulic pivot drive 21 about a pivot axis 19 extending perpendicularly to a ballast excavation plane 22.

As can be seen in FIGS. 2 to 4, a ballast conveyor 24 designed for ballast transport in the direction towards the pivot axis 19 by means of a conveyor drive 23 is arranged on the ballast deflector blade 20 on a blade plane 26 facing the transverse channel 15. Said ballast conveyor 24 is designed as a screw conveyor rotatable about an axis of rotation 25 extending parallel to the ballast excavation plane 22 and parallel to the blade plane 26.

As visible in FIG. 3, the ballast conveyor 24 in a further variant is designed to be vertically adjustable relative to the ballast deflector blade 20 by means of a drive 27. A guide 28 provided for vertical adjustment extends parallel to the pivot axis 19.

According to a variant shown schematically in FIG. 3, the ballast conveyor 24 is designed to be pivotable about a pivot axis 29 extending perpendicularly to the blade plane 26 of the ballast blade 20.

As visible in FIG. 4, the ballast conveyor 24 can be configured as a conveying chain 32 having a number of blades 31 and being deflectable about two axes 30 spaced from one another.

An electronic sensor 33 provided for motion detection or for distance measuring (FIG. 2) is arranged directly on the ballast deflector blade 20 for automatic actuation of the pivot drive 21 and serves for automatic detection of a catenary mast 34.

The invention will be described in more detail below with regard to a working operation. For ballast cleaning, the machine 1 is moved continuously in the working direction 3, wherein the ballast 6 located underneath the track 4 is collected in the region of the transverse channel 15 and conveyed in the direction towards the connecting joint 18 and, in further sequence, transported upward in the transport channel 17 to the discharge end 9. During this, the position of the ballast deflector blade 20 with respect to the track 4 is constant and such that a catenary mast 34 can be passed without problem.

As soon as the catenary mast 34 has been passed, this is registered by the sensor 33 which then automatically activates an actuation of the pivot drive 21. This causes a swivelling outward of the ballast deflector blade 20 together with the ballast conveyor 24 which is now set in rotation after activation of the conveyor drive 23 for conveying the ballast 3 located within reach. The ballast 3 conveyed in this manner in the direction toward the transition from the transverse channel 15 to the transport channel 17 is at last automatically collected by the rotating clearing chain 8 and transported upwards in the transport channel 17 to the discharge end 9. The drive 27 enables an optimal adaptation of the ballast conveyor 24 to the ballast mass backed up by the ballast deflector blade 20.

As soon as the next catenary mast 34 comes within the radius of action of the sensor 33, the ballast deflector blade 20 is automatically pivoted back into the initial position for problem-free passing. Said pivoting of the ballast deflector blade 20 could of course also be controlled manually by an operator. In case that no ballast 3 is located between the catenary masts 34, an activation of the ballast conveyor 24 is naturally not required. Rather, the latter stays permanently in an inoperative position, wherein the already known function of the ballast deflector blade 20 remains available without restriction. Advantageously, the sensor 33 can also trigger an acoustical and/or optical warning signal.

The invention claimed is:

1. A machine comprising:

a ballast take-up device for taking up ballast located underneath a track;

an endless clearing chain;

a chain channel wherein said endless clearing chain is guided in said chain channel, wherein the chain channel comprises:

i) a transverse channel located underneath the track, ii) an empty channel iii) a transport channel provided for ballast transport, iv) a connecting joint;

a ballast conveyor;

a conveyor drive; and a ballast deflector blade pivotable about a pivot axis which is fastened in said connecting joint from the transverse channel to the transport channel, wherein said ballast conveyor, is designed for ballast transport in a direction towards the pivot axis by means of a conveyor drive, is arranged on the ballast deflector blade.

2. The machine according to claim 1, wherein the ballast conveyor is designed to be vertically adjustable relative to the ballast deflector blade by means of a drive.

3. The machine according to claim 2, wherein a guide provided for vertical adjustment is arranged parallel to the pivot axis.

4. The machine according to claim 1, wherein the ballast conveyor is designed to be pivotable about an axis extending perpendicularly to a blade plane of the ballast deflector blade.

5. The machine according to claim 1, wherein the ballast conveyor is designed as a screw conveyor rotatable about an axis of rotation.

6. The machine according to claim 1, wherein the ballast conveyor is designed as a conveyor chain, having a number of blades, which is deflectable about two axes spaced from one another.

7. The machine according to claim 1, wherein the ballast deflector blade is designed to be adjustable about the pivot axis by means of a pivot drive.

8. The machine according to claim 7, wherein an electronic sensor provided for motion detection or for distance measuring is arranged directly on the ballast deflector blade for automatic actuation of the pivot drive.

* * * * *